US006875066B2

(12) United States Patent
Wolaver

(10) Patent No.: US 6,875,066 B2
(45) Date of Patent: Apr. 5, 2005

(54) SOUND INSULATION FOR OUTBOARD MOTORS

(75) Inventor: Carl L. Wolaver, Newark, DE (US)

(73) Assignee: Polymer Technologies, Inc., Newark, DE (US)

( * ) Notice: Subject to any disclaimer, the term of this patent is extended or adjusted under 35 U.S.C. 154(b) by 0 days.

(21) Appl. No.: 10/787,799

(22) Filed: Feb. 26, 2004

(65) Prior Publication Data

US 2004/0169373 A1 Sep. 2, 2004

Related U.S. Application Data

(60) Provisional application No. 60/451,078, filed on Feb. 28, 2003.

(51) Int. Cl.[7] ..... B63H 21/36
(52) U.S. Cl. ..... 440/77; 181/204
(58) Field of Search ..... 440/76, 77; 123/195 C; 181/204

(56) References Cited

U.S. PATENT DOCUMENTS 3,195,530 A * 7/1965 Heidner ..... 123/198 R
3,358,668 A 12/1967 Post et al.
3,845,839 A * 11/1974 Eriksson ..... 440/52
3,936,565 A 2/1976 Good
3,955,526 A 5/1976 Kusche
4,348,194 A 9/1982 Walsh
4,978,321 A * 12/1990 Ferguson ..... 440/88 R
5,080,618 A 1/1992 Dunham et al.
5,082,716 A 1/1992 Satterfield et al.
5,504,282 A * 4/1996 Pizzirusso et al. ..... 181/290
6,319,969 B1 11/2001 Walther et al.
6,358,106 B1 * 3/2002 Herrera ..... 440/77
6,369,120 B1 4/2002 Chaudhary et al.
6,471,557 B1 10/2002 Hattori
2002/0016110 A1 2/2002 Lecours

* cited by examiner

*Primary Examiner*—Andrew D. Wright
(74) *Attorney, Agent, or Firm*—RatnerPrestia

(57) ABSTRACT

Sound insulation for an engine contained within an outer casing, the insulation made up from a minimal number of interlocking molded foam insulation pieces forming a substantially continuous shroud surrounding the operating parts of the engine and having an outer surface matching the inner shape of the outer casing and in contact therewith. Preferably the outer casing is used to generate the molds used to manufacture the molded sound insulation pieces, thereby providing a good surface fit between the outer insulation surface and the inner casing surface.

13 Claims, 2 Drawing Sheets

SOUND INSULATION FOR OUTBOARD MOTORS

CROSS-REFERENCE TO RELATED APPLICATIONS

This application claims priority from U.S. provisional application Ser. No. 60/451,078 filed on Feb. 28, 2003, the contents of which are incorporated herein by reference in their entirety.

FIELD OF THE INVENTION

This invention relates to sound insulation and more particularly to sound insulation for an outboard motor using molded sound material to provide a substantially complete enclosure for such motor, and more particularly to a sound insulating casing formed of molded foam materials.

BACKGROUND OF THE INVENTION

Motors, particularly internal combustion motors generate high levels of noise and require some form of sound insulation before they are acceptable by the general public. Where space permits, enclosures are built around such motors and sound absorbing material is installed within the enclosure to reduce or redirect the sound level particularly in the area occupied by the user of the motor, or others nearby. Typically such enclosures are generally rectangular boxes or fitted covers designed to fit closely to the motor itself, with slabs of insulation material affixed to the inside wall of the enclosure. When the enclosure provides generally large flat surfaces joined at 90°, slab insulation is usually not too difficult to apply and the results are reasonably effective.

Unfortunately sound insulation using slab material becomes less effective when the casing of the motor is no longer a square box but due to design requirements comprises curved, particularly compound curved surfaces. Such, for example, is the situation of an outboard engine commonly used to power a large number of boats. In such applications, slab insulation requires the use of a large number of sound insulating material pieces to cover the inside surface of the casing. Such sound reduction method is expensive to implement and is not very effective as it tends to leave gaps through which sound escapes thereby reducing the effectiveness of the sound insulation package.

In addition, it has been observed that at times and for certain frequencies, the cover panels of the motor enclosure vibrate and further amplify the engine sounds. There is, therefore, still considerable need for improvement in this area, both from the economic point of view as well as the effectiveness of the sound reduction.

SUMMARY OF THE INVENTION

The present invention provides shaped, as by molding, foam sound insulation thereby greatly reducing the required pieces to cover a given motor. The insulation is molded to a shape designed to fit within an existing outer casing of such motor, such as the casing of an outboard motor formed by a cowl and body panels. Such motor sound insulation comprises a minimal number of interlocking molded foam insulation pieces forming a shroud surrounding the operating parts of the motor and having an outer surface matching the inner shape of the outer casing and in contact therewith. Preferably the outer casing is used to generate the molds used to manufacture the molded sound insulation pieces, thereby providing a good surface fit between the outer insulation surface and the inner casing surface.

More particularly, according to this invention there is also provided sound insulation of an outboard motor comprising:

(a) an engine, which may be an internal combustion engine, coupled to a cooling and exhaust manifold and, optionally, a drive mechanism for driving a propeller, and (b) an outer cover encasing at least said engine, and cooling and exhaust manifold, wherein the sound insulation comprises a substantially continuous shroud formed by at least two and preferably three separable sections of a molded flexible resilient material placed in said outer cover, said shroud having an outer surface shaped substantially complementary to an inner surface of said cover and wherein said outer shroud surface is in contact with said inner surface of said cover.

Still in accordance with this invention, the materials used for the molded sound insulation shroud comprise a resilient material such as, for example, natural or synthetic rubber, or polymeric foam which may be formed using, again for example, a urethane resin. Still more preferably such urethane insulation material has a core and an outer skin layer and exhibits a variable density profile, wherein the density of the cell structure varies from high at the outer skin (almost a solid film, having a density of 20–30 lbs./cubic foot) to a fine cellular uniform nature at the core (a density of 4 to 22 lbs. per cubic foot).

DETAILED DESCRIPTION OF THE INVENTION

The invention will next be described with reference to the figures wherein same numerals indicate same elements. The figures are provided by way of illustration rather than limitation and are neither to scale nor do they include all elements of the outboard motor used to illustrate this invention but are limited to only show as many elements as are necessary to convey an understanding of the present invention to one skilled in the art.

The invention will also be illustrated with reference to an outboard motor using an internal combustion engine. Internal combustion engines are the engines most commonly used in similar applications however the invention is not limited to sound insulation of internal combustion engines but can be used with turbine type engines, electric motors or any other type of engine whose noise level needs reduction. And while an outboard engine is used for illustrating the invention, the invention is not limited to outboard motor sound proofing but includes other similar engine applications such as inboard-outboard engines, engines for personal watercraft, snowmobiles, garden equipment and so on.

Figure 1:
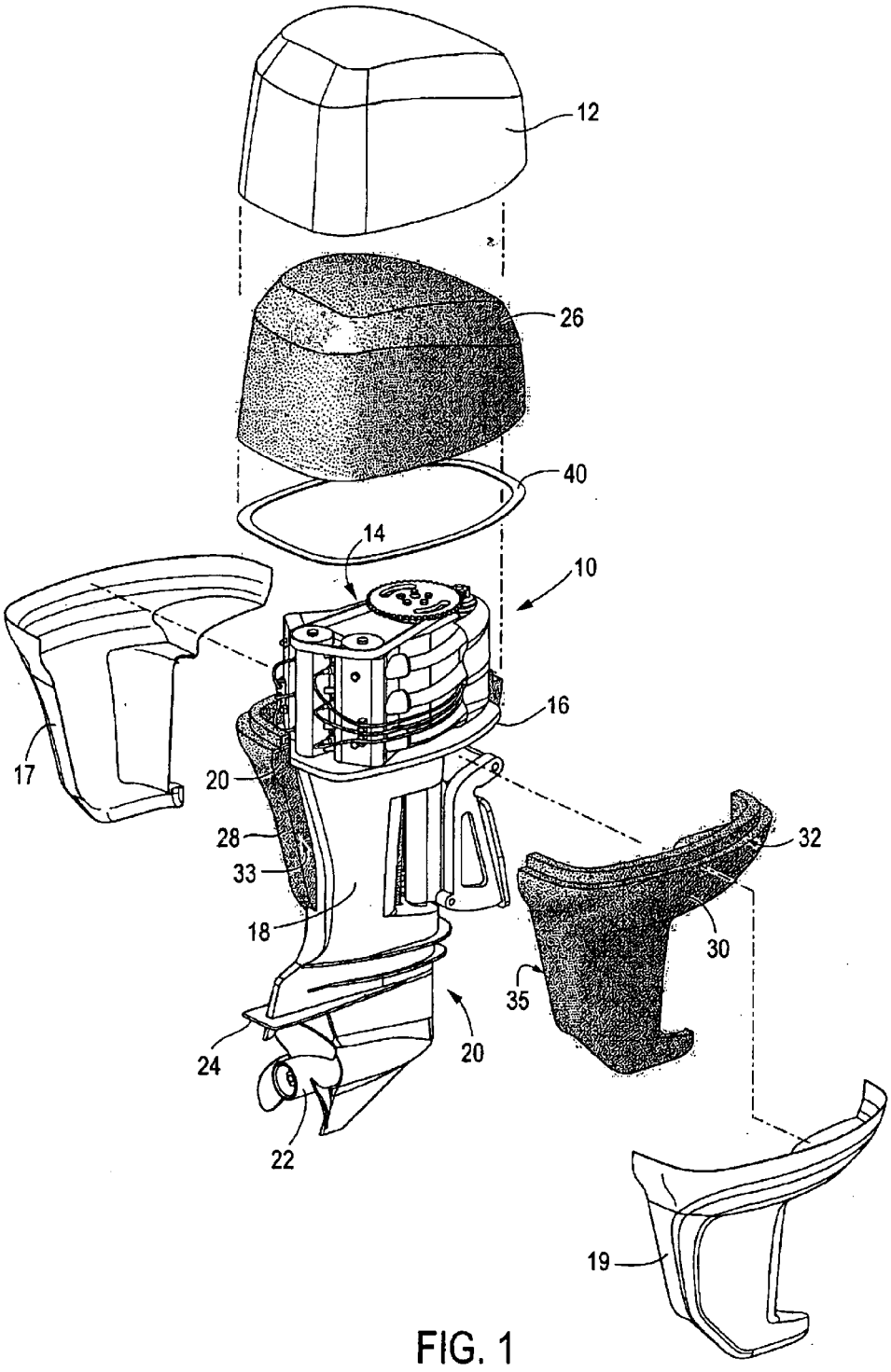
FIG. 1 is an exploded view of the major parts of an outboard motor and the sound insulation shroud according to this invention.

As shown in FIG. 1 which is an exploded view of a typical outboard motor showing the parts needed to illustrate this invention. Such parts comprise an upper section 10 covered by a cowl 12 containing an internal combustion engine 14 mounted on a plate 16 generally known as a transition plate. Below the transition plate the outboard includes a middle section. This middle section contains an exhaust manifold in an exhaust canister 18 connected to the engine through transition plate 16. Two outer shell covers 17 and 19 enclose the exhaust canister. The middle section is connected to a lower unit 20 which is immersed when the motor is in use. The lower unit contains a propeller 22, a anti-cavitation plate 24 and a gear drive (not shown).

Typically cooling water from the engine cooling system flows together and mixes with the exhaust gasses in the exhaust manifold and both the water and the gasses exit under water through the propeller center. A drive mechanism connects the engine to the propeller.

The cowl 12 and middle section shell covers 17 and 19 are typically made of a synthetic material generally referred to as "plastic" while the lower unit is made usually of metal. The lower unit, top cowl and side panels are assembled together to form a watertight or at least a splash proof assembly.

As also shown in FIG. 1, there is provided according to the present invention a molded sound insulating shroud formed by three distinct molded pieces 26, 28 and 30. Top piece 26 is molded to fit inside the cowl and encase the top and sides of the engine 14. The two side pieces 28 and 30 are similarly molded to fit inside the outer side shell panels 17 and 19 respectively, between the panels and the exhaust canister 18. Thus, the shroud, when assembled, fits inside the cowl and side panels and surrounds the engine 14 and exhaust canister 18 completely.

This particular structure is preferred because it permits access to the internal combustion engine by lifting the cowl 12 with the top insulation piece 26 in one piece. If such access is not needed, the shroud can be made from two pieces corresponding the right and left sides, or front and back of the outboard motor such that the shroud sandwiches and encases the complete interior parts of the motor.

Figure 2:
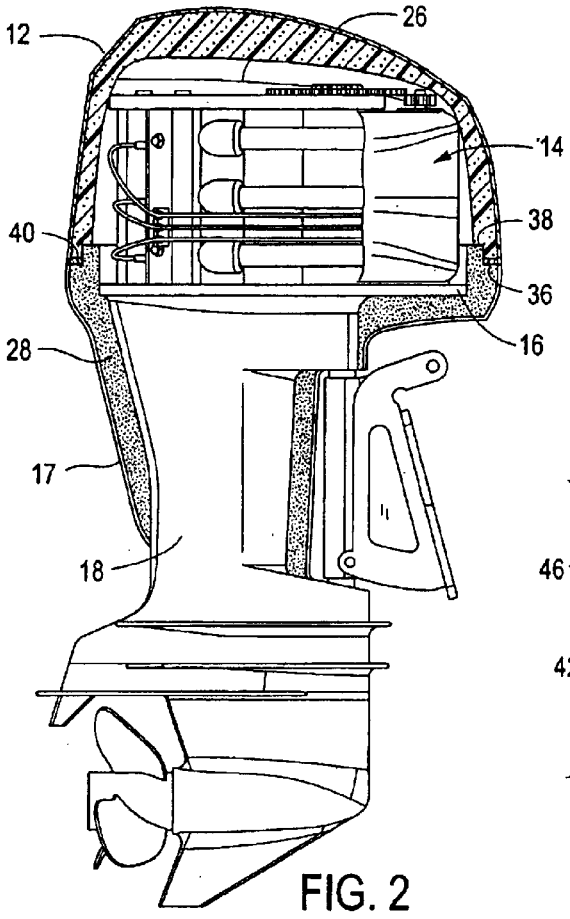
FIG. 2 is schematic representation of a cross section of an outboard in accordance with this invention showing the placement and interlocking of the molded insulation in a typical outboard motor.

FIG. 2 shows the positioning of the insulation inside the outboard cover. Typically the lower section 20 of the engine does not include any insulation because it is immersed under water during operation and the water serves to muffle the exhaust. However if desirable molded foam insulation may be extended to this section of the motor.

When the insulation is added to an existing design, the interior of the. insulating shroud is dimensioned and shaped so that it does not contact any engine parts, yet provides the maximum insulating material thickness between the cowl internal surface and the engine. Of course in a new design the cowl may be made bigger to accommodate extra thickness in the shroud for even better sound insulation compared what is achieved when the insulation material thickness is limited by the available space in an existing product.

Figure 4:
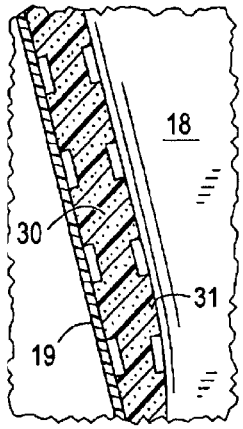
FIG. 4 is a schematic representation of a cross section of the lower part of an outboard motor showing one embodiment of molded insulation in contact with the cover shell and the exhaust canister.

In a preferred embodiment, when the exhaust manifold temperature permits, as in the case of water cooled exhausts, the side pieces 28 and 30 are designed to contact both the exhaust canister 18 and the side cover panels 17 and 19, thereby buffering any side panel vibrations and preventing such vibrations from amplifying the engine noise. Contact may be along the full surface or, as shown in FIG. 4, the molded insulation 30 may include a plurality of ridges 31 and contact one or both the side panel 19 or the exhaust canister 18 along the ridges.

It has been observed that the surface of the shroud does not have to contact the side panels and the exhaust canister along the full surface area, and that certain point contacts are sufficient to dampen the vibrations. Point contact may be using an arbitrary arrangement of ridges or, preferably the ridges and contact points may be calculated or experimentally determined to provide maximum vibration damping. However, while such point contact is within the scope of this invention, it is preferred to use full or maximum surface contact whenever possible.

Typically the pieces forming the shroud will be either pressure, or friction fitted inside the cowl and side panels, adhered to the inside cowl or side panel surfaces with a suitable adhesive, mechanical, or other attaching means such as rivets, screws etc. or any combination of the above. Pressure fitting is preferred for the top piece fitting inside the cowl, while the shroud parts covering the lower unit exhaust canister are preferably adhered to the inner surface of the outer side panels of the motor.

Figure 3:
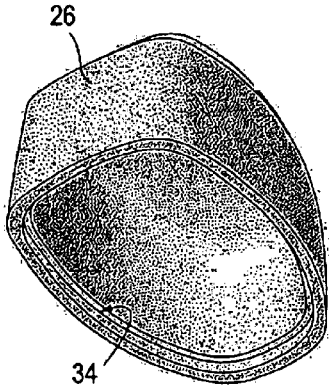
FIG. 3 is a three dimensional schematic representation of a molded insulation material for use within the cowl of an outboard motor in accordance with the present invention.

A shown in FIGS. 1, and 3, the insulation panels have abutting edges 32, 34 and 33, 35 abutting each other when fully assembled in place within the motor outer housing. In the illustrate case, the side insulating panels preferably terminate at their top end to a small, step-like ledge 36 better shown in FIG. 2. As shown in FIG. 2 this ledge 36 is sized to fit within a corresponding inverted ledge 38 along the bottom lip of abutting shroud top piece 26 thereby more completely engaging the side insulating panels 28 and 30 with the top piece 26. While a step-like ledge is shown the illustration, other complementary shapes are possible. For example one edge may include a groove and the opposite edge a raised wall sized to fit within the groove. The intent of such complementary engaging edge design is to provide a demountable connection that forms a substantially continuous barrier to sound transmission from within the shroud to outside the shroud.

Each of the side insulating panels may also have co-operating engaging ledges along their inner lips to provide a substantially seamless joint such that the full assembled insulation cover of the outboard forms a substantially continuous sound barrier fitted inside the outboard removable cowl and side panels, or may terminate to a plain edge as shown in FIG. 1. If desired, a gasket 40 may be placed between the top piece 26 lip and the upper lip of the port and starboard insulation side panels 28 and 30, or between any other abutting edges.

Preferably the sound insulating pieces are made of a sound absorbing, resilient, self supporting molded material such as polyurethane, neoprene, fibermat, polyethylene, polypropylene, expanded bead material, etc. In a preferred embodiment, the material selected is two component molded polyurethane foam as this material has excellent acoustical properties due to its microcellular nature and extremely thin film (skin) surface (usually less than 0.010" thick). It also provides a number of advantages. For example:

1. The above referred to skin can be varied in thickness with changes in formulation, and variations in temperature of the mold.

2. The sound energy is dissipated by causing the cellular membranes to deform, creating minute amounts of heat energy. Cellular membranes are the windows formed during the foaming process whereby a gas is formed causing the material to expand causing bubbles to form, the walls of which are the chemicals them selves, i.e. urethane etc.

3. The density can be varied between 4 and 22 lbs/cu ft. to optimize the acoustical quality of the foam to absorb sound in various parts of the frequency spectrum. This is done by varying the ratio of the catalyst and blowing agent to the base resin. Density plays a significant role in determining the absorption characteristics of the foam vs. frequency spectrum. A higher density foam has better absorption characteristics in very low frequencies, i.e. 100–200 hertz. The lower density (4–9 lbs.) has better absorption over a much broader frequency spectrum (250–4000 hertz), depending on thickness.

4. The thickness of the surface skin plays a significant role in the ability of sound energy to enter into the foam core of the material and be dissipated.

An extremely thin skin on the foam has the ability to absorb a wide frequency range (100 to 5000 hertz) whereas the thicker the surface skin (0.007 mils) the more high energy will be reflected off the surface and only extremely low frequency energy (below 300 hertz) will be able to penetrate the foam and be absorbed. This is because as the density of the foam increases substantially as well as the surface film thickness, the sound energy is reflected off the outer surface of the skinned foam.

The higher density foam 16 lbs/cu ft. acts more as a barrier than an absorber because the cell structure tends to be extremely small and the windows/membranes of the cell walls thick in comparison to the surrounding skeletal structure further inhibiting sound energy from penetrating into the medium. The mass (weight per unit area) and thickness also determine the transmissibility or reflectivity of sound energy of the foam. As an example, when the weight or density of the molded foam polyurethane is in the 18–22 lb. range, one gets almost complete reflectivity of all but extremely low frequencies of sound energy above 20 hertz.

Figure 5:
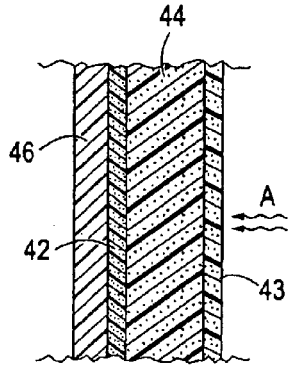
FIG. 5 is a typical schematic representation of a cross section of the molded material used in the present invention.

Thus a material having the structure shown in FIG. 5, that is a material comprising an inner and an outer skin 42 and 43 respectively encasing a core 44 and having different densities may have its density profile adjusted to permit sound penetration to the core from a first side, but deny sound penetration through the other side. By placing the first side toward the sound source (Arrow "A") and the reflecting side against the outer motor casing 46 the degree of sound absorption in particular frequencies is optimized. The flexible nature of the microcellular urethane foam helps to absorb the structural borne energy and reduce the vibration of the motor and its covers. By varying the density of the cell structure from high at the outer skin (almost a solid film, density of outer skin 20–30 lbs./cubic foot) to a fine cellular uniform nature at the core (a density of 4 to 9 lbs. per cubic foot), the insulating material absorbs a wide variety of sound in a 20 hertz to 20,000 hertz range, but particularly well in the 200 to 4000 hertz range.

As stated earlier, a contributing source of noise is sound induced vibrations of the panels forming the motor outer casing, particularly sound frequencies inducing resonant vibrations. The molded foam structures of the present invention isolate or separate one vibrating surface from another. This is accomplished by using foam insulation pieces in the 4–19 lbs/ft$^3$ foot density range having an outer surface in intimate contact with the housing inner surface or by designing the pieces with appropriate steps, buttons, or ribs which contact the vibrating surface in specific areas to damp out such vibration induced noise.

The preferred foam molding process involves mixing a catalyzed urethane resin and an isocyanate in a blending chamber and discharging the continually mixed liquid into a mold (the mold can be made of metal, aluminum, epoxy (or silicone) resin, wood, plastic, or a combination of any materials which will hold the liquid, during the expansion process until the part is cured, at least to a "green state" where the part can be removed from the mold without distorting its shape. Complete curing takes several hours and a modest amount of shrinkage (usually 1–1½%) will occur.

The mold is typically of a clamshell nature, similar to a waffle iron. The molds for each insulation piece are preferably created by lifting the inner form of actual outer casing panels thereby obtaining a perfect fit of the molded insulation pieces with the inner surface of the outer casing. The catalyzed urethane resin and isocyanate mixture are poured into the "bottom" section and the top is closed onto the bottom and clamped shut. Slides may be included in the process to produce a part with holes or features which can not be accommodated in a two-part mold.

Preferably, the molding process used to prepared molded foam polyurethane parts according to this invention having a structure comprising an outer skin on both sides with a core cellular in nature having preferably, a random cell pattern of broken cells, comprises:

1. preparing molds comprising male and female portions for each of the pieces that will ultimately form the insulation shroud.

2. pouring the two part polymer catalyst into the mold and securing closed.

3. applying heat between 100° and 200° F. for about between 10 and 30 minutes depending on the reactive nature of the actual materials used.

4. opening and removing the molded foam part.

Preferably, the molded foam part should be a flexible and resilient semi-closed or open cell material having a core between two outer skin films with density range of between 4 and 22 lbs/ft$^3$ substantially uniform throughout the core. As the person skilled in the art will understand the terms "skin" and substantially uniform are intended to describe a structure comprising a completely separate film layer as would result from laminating a different density film to the "core" but is a skin formed during the cooling of the molded part integral with the core, but exhibiting a rapid change in density from the core to the outer surface of the piece inside the immediate vicinity of the outer surface, rather than the abrupt density change that is the result of laminating a film having a density other than the core density to the core. The core density will typically vary from high at the skin surfaces to some median value at the centerline between the two outer surfaces, and can vary somewhat as the thickness of the part varies in different areas of the mold. The core density can be from 4 lbs to 22 lbs/ft$^3$ depending on formulation. The outer skin density will be much higher 20 to 30 lbs/ft$^3$, or higher.

There are two major areas for noise emanating from a 2- or 4-cycle outboard engine: the air intake, and the exhaust for two and four cycle outboards, where the exhaust exits below the water line, typically through the center of the prop or through an exhaust port typically located in proximity to the prop or impeller above the prop, under the anti-cavitation plate. One of the largest sources of noise is from the lower motor section above the water line. In experiments with actual outboard motors and by employing the 4–12 lbs/ft$^3$, core molded foam between the outer side panels and engine lower housing, the noise level emanating from this area was reduced by several dB, from as little as 2 dB to as much as 20 dB, depending on frequency, thickness and density of the shroud.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A sound insulation of an outboard motor comprising:

(a) an engine, an exhaust manifold and a drive mechanism for driving a propeller, and (b) an outer cover encasing said engine, exhaust manifold and at least a portion of said drive mechanism, wherein the sound insulation comprises a substantially continuous shroud formed by at least two separable sections of a molded flexible resilient material placed in said outer cover, said molded flexible resilient material comprising a semi-closed cell or an open cell structure having a core between a first and a second outer skin said core having a substantially uniform density of between 4 and 12 lbs/ft$^3$ and said first and second outer skin density of between about 20 and 30 lbs/ft$^3$, said shroud having an outer surface shaped substantially complementary to an inner surface of said outer cover and wherein said outer shroud surface is in contact with said inner surface of said outer cover.

2. The sound insulation according to claim 1 wherein said molded flexible resilient material consists essentially of molded foam urethene.

3. The sound insulation according to claim 2 wherein said molded foam urethane comprises two component polyurethane.

4. The sound insulation system according to claim 1 wherein said at least two separable sections of a molded foam urethane comprise microcellular urethane having variable density cell structure.

5. A sound insulation of an outboard motor comprising:

(a) an engine, an exhaust manifold and a drive mechanism for driving a propeller, and (b) an outer cover encasing said engine, exhaust manifold and at least a portion of said drive mechanism, wherein the sound insulation comprises a substantially continuous shroud formed by at least two separable sections of a molded flexible resilient material placed in said outer cover, said molded flexible resilient material comprising a core having a density and wherein said core density increases from an inner side of said shroud toward an outer side thereof said shroud also having an outer surface shaped substantially complementary to an inner surface of said outer cover and wherein said outer shroud surface is in contact with said inner surface of said outer cover.

6. A sound insulation of an outboard motor comprising:

(a) an engine, an exhaust manifold and a drive mechanism for driving a propeller, and (b) an outer cover encasing said engine, exhaust manifold and at least a portion of said drive mechanism, wherein the sound insulation comprises a substantially continuous shroud formed by at least two separable sections of a molded flexible resilient material placed in said outer cover, said shroud has an outer surface shaped substantially complementary to an inner surface of said outer cover and said outer shroud surface is in contact with said inner surface of said outer cover and wherein said exhaust manifold further comprises an exhaust canister and said shroud has an inner surface in contact with at least a portion of said exhaust canister.

7. The sound insulation according to claim 6 wherein said shroud inner surface comprises a plurality of ribs and said ribs contact said exhaust canister.

8. The sound insulation according to claim 6, wherein said shroud contacts said exhaust canister and said outer cover opposite said exhaust canister along selected contact points.

9. The sound insulation according to claim 8 wherein said contact points are selected to dampen resonant vibrations in said outer cover.

10. A sound insulation of an outboard motor comprising:

(a) an engine, an exhaust manifold and a drive mechanism for driving a propeller, and (b) an outer cover encasing said engine, exhaust manifold and at least a portion of said drive mechanism, wherein the sound insulation comprises a substantially continuous shroud formed by at least two separable sections of a molded flexible resilient material placed in said outer cover, said shroud has an outer surface shaped substantially complementary to an inner surface of said outer cover and said outer shroud surface is in contact with said inner surface of said outer cover, said at least two separable sections of said molded flexible resilient material terminate along abutting edges and there is a gasket placed between said abutting edges of said sections.

11. A sound insulation of an outboard motor comprising:

(a) an engine, an exhaust manifold and a drive mechanism for driving a propeller, and (b) an outer cover encasing said engine, exhaust manifold and at least a portion of said drive mechanism, wherein the sound insulation comprises a substantially continuous shroud formed by at least two separable sections of a molded flexible resilient material placed in said outer cover, said shroud has an outer surface shaped substantially complementary to an inner surface of said outer cover and said outer shroud surface is in contact with said inner surface of said outer cover, said at least two separable sections of said molded flexible resilient material terminate along abutting edges and wherein said abutting edges comprise complementary engaging lips.

12. The sound insulation according to claim 11 further comprising a gasket between said complementary engaging lips.

13. A method for sound insulating a marine motor comprising an engine section, an exhaust manifold, and a canister around at least a portion of said exhaust manifold the method comprising:

(a) forming a molded foam shroud comprising at least two interlocking demountable insulating material sections molded to fit an inside surface of an existing casing for such motor wherein said at least two interlocking demountable insulating material sections form a substantially continuous sound barrier and wherein said shroud inner surface is designed to contact at least a portion of said canister and (b) encasing said motor with said shroud, said shroud being in contact with said inside surface of said casing.

* * * * *